US008794792B1

(12) United States Patent
Moghal et al.

(10) Patent No.: US 8,794,792 B1
(45) Date of Patent: Aug. 5, 2014

(54) OPTICAL SPILL LIGHT REDUCER FOR LUMINAIRES

(75) Inventors: Khurram Zeshan Moghal, Senoia, GA (US); Gerry Thornton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/220,411

(22) Filed: Aug. 29, 2011

Related U.S. Application Data

(60) Provisional application No. 61/381,354, filed on Sep. 9, 2010.

(51) Int. Cl.
*F21V 5/00* (2006.01)

(52) U.S. Cl.
USPC ..... 362/248; 362/240

(58) Field of Classification Search
CPC ..... H01L 33/58; H01L 33/60; G02B 5/003; G09F 2013/222; G09F 2013/225
USPC ..... 362/240, 290, 303, 346, 344, 354, 248
See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 5,617,131 | A * | 4/1997 | Murano et al. | 347/233 |
| 7,845,827 | B2 * | 12/2010 | Tarter et al. | 362/247 |
| 7,914,162 | B1 * | 3/2011 | Huang | 362/92 |
| 2003/0202349 | A1 * | 10/2003 | Suehiro et al. | 362/245 |
| 2009/0161360 | A1 * | 6/2009 | Li et al. | 362/235 |
| 2010/0046223 | A1 * | 2/2010 | Li et al. | 362/249.02 |

OTHER PUBLICATIONS

Gemma Lighting Limited; Sun 24XL110 LED Flood Light; Product Specification; Aug. 2010.
Gemma Lighting Limited; Sun 48XL110 LED Flood Light; Product Specification; Aug. 2010.
BetaLED; FLD-EDG-10-SA, The Edge, LED Floodlight; Product Specification; Dec. 8, 2009.
Philips Lighting; IW Blast Powercore; Product Specification; Dec. 2009.
Philips Lighting; IW Reach Powercore; Product Specification; Aug. 2009.
Insight Lighting; Masque II; Product Specification; Jun. 2010.
Kim Lighting; Hubbell; CFL; Compact Floodlights; Product Specification; Sep. 23, 2009.
Philips, Allscape; FL-02; Product Specification; Jun. 2009.
Affineon Lighting; VS-Vision; Product Specification; Aug. 2010.
Beacon LED; FL-1LED Floodlight; Brochure and Product Specification; Sep. 14, 2009.
Architectural Area Lighting; Oculus-OS; Product Specification Jan. 2010.

* cited by examiner

*Primary Examiner* — Nimeshkumar Patel
*Assistant Examiner* — Christopher Raabe
(74) *Attorney, Agent, or Firm* — King & Spalding LLP

(57) ABSTRACT

A spill light reducer assembly includes at least one light source, at least one reflector, and a spill light reducer plate. The reflector includes a proximal end disposed about one or more corresponding light sources and a distal end extending outwardly from the proximal end. The spill light reducer plate includes at least one opening formed therein, which is positioned a predetermined distance away from the distal opening. The light source emits a main light beam and a spill light beam surrounding the main light beam. The spill light reducer plate reduces the amount of spill light emitted through the opening of the spill light reducer plate. A light fixture includes a housing that defines a cavity and a light emitting window. The spill light reducer plate is disposed within the cavity.

17 Claims, 8 Drawing Sheets

OPTICAL SPILL LIGHT REDUCER FOR LUMINAIRES

RELATED APPLICATION

This application claims priority under 35 U.S.C. §119 to U.S. Provisional Patent Application No. 61/381,354, titled "Vision Flood LED Optics Spill Light Reducer," filed on Sep. 9, 2010, the entire contents of which are hereby fully incorporated herein by reference.

TECHNICAL FIELD

The present disclosure relates generally to optics for controlling and reducing spill light from light sources, and more particularly to systems, methods, and devices for eliminating or reducing spill light generated by the optics of light sources.

BACKGROUND

The use of LEDs in place of conventional incandescent, fluorescent, and neon lamps has a number of advantages. LEDs tend to be less expensive and longer lasting than conventional incandescent, fluorescent, and neon lamps. In addition, LEDs generally output more light per watt of electricity than incandescent, fluorescent, and neon lamps. Further, LEDs typically generate less heat during operation than conventional incandescent, fluorescent, and compact fluorescent lamps. Although some advantages for LEDs have been mentioned, there are several additional advantages that LEDs provide.

LEDs can be positioned adjacent to one another for illuminating a desired area. In certain instances, an optical device, such as a reflector, is disposed over or around one or more of the LEDs to control the light emitted from the respective LEDs. FIG. 1 shows a light distribution pattern 100 formed on a wall 110 when using conventional optics with a light source in accordance with the prior art. Conventional optics used in conjunction with LEDs generally produce a main light beam 120 and a spilled light beam 130 that radially surrounds the main light beam 120. The main light beam 120 is more intense and has a higher lumen output than the spilled light beam 130. In addition, the spilled light beam 130 typically illuminates undesired and/or unintentional areas.

As LEDs become more popular due to its benefits, LEDs are being used in many different lighting applications. For example, LEDs are used in street lighting, flood lighting, indoor lighting, sign lighting, and work light applications. There are some LED applications that would benefit by reducing and/or eliminating the amount of spill light generated by an LED fixture.

SUMMARY

An exemplary embodiment includes a spill light reducer assembly. The spill light reducer assembly can include at least one light source, at least one reflector, and a spill light reducer plate. Each reflector can include a reflector proximal end, a reflector distal end, and a reflector internal surface extending from the reflector proximal end to the reflector distal end. The reflector proximal end can be disposed around the light source. The reflector distal end can form a distal opening. The spill light reducer plate can include at least one opening formed therein. The opening can be positioned a predetermined distance away from the distal opening.

Another exemplary embodiment includes a light fixture. The light fixture can include a housing, a plurality of light emitting diodes (LEDs), at least one reflector, and a spill light reducer plate. The housing can include one or more sidewalls and a cavity. The sidewalls can form a light emitting window. The cavity can be disposed within the housing and can be defined by the sidewalls. The plurality of LEDs can be disposed within the cavity. Each reflector can be disposed at least partially within the cavity. Each reflector can include a reflector proximal end, a reflector distal end, and a reflector internal surface extending from the reflector proximal end to the reflector distal end. The reflector proximal end can surround at least one LED. The reflector distal end can form a distal opening. The spill light reducer plate can be disposed within the cavity and can include at least one opening formed therein. At least a portion of the opening can be aligned with a portion of the distal opening and can be positioned a predetermined distance away from the distal opening.

Another exemplary embodiment includes a method for reducing spill light from a light source. The method can include placing a reflector over one or more light sources. The reflector can include a reflector proximal end, a reflector distal end, and a reflector internal surface extending from the reflector proximal end to the reflector distal end. The reflector distal end can form a distal opening. The method also can include positioning a spill light reducer plate a predetermined distance away from the reflector. The spill light reducer plate can include at least one opening formed therein.

BRIEF DESCRIPTION OF THE DRAWINGS

The foregoing and other features and aspects are best understood with reference to the following description of certain exemplary embodiments, when read in conjunction with the accompanying drawings, wherein.

Figure 1:
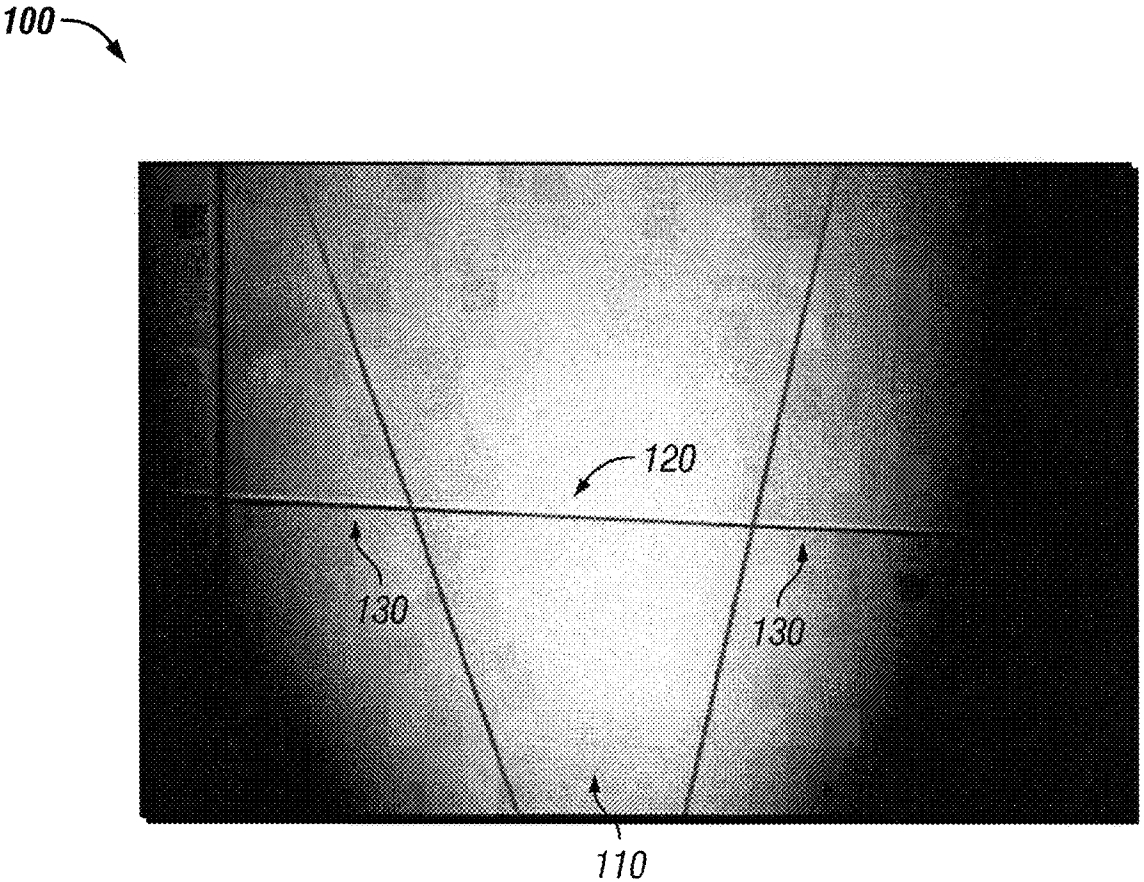
FIG. 1 shows a light distribution pattern formed on a wall when using conventional optics with a light source in accordance with the prior art.

The drawings illustrate only exemplary embodiments and are therefore not to be considered limiting of its scope, as the inventive aspects may admit to other equally effective embodiments.

DETAILED DESCRIPTION OF THE EXEMPLARY EMBODIMENTS

The exemplary systems, methods and apparatus described herein are directed to eliminating or reducing spill light generated by the optics of light sources, including LED light sources. The concepts are better understood by reading the following description of non-limiting, exemplary embodiments with reference to the attached drawings, wherein like parts of each of the figures are identified by like reference characters, and which are briefly described as follows.

Figure 2A:
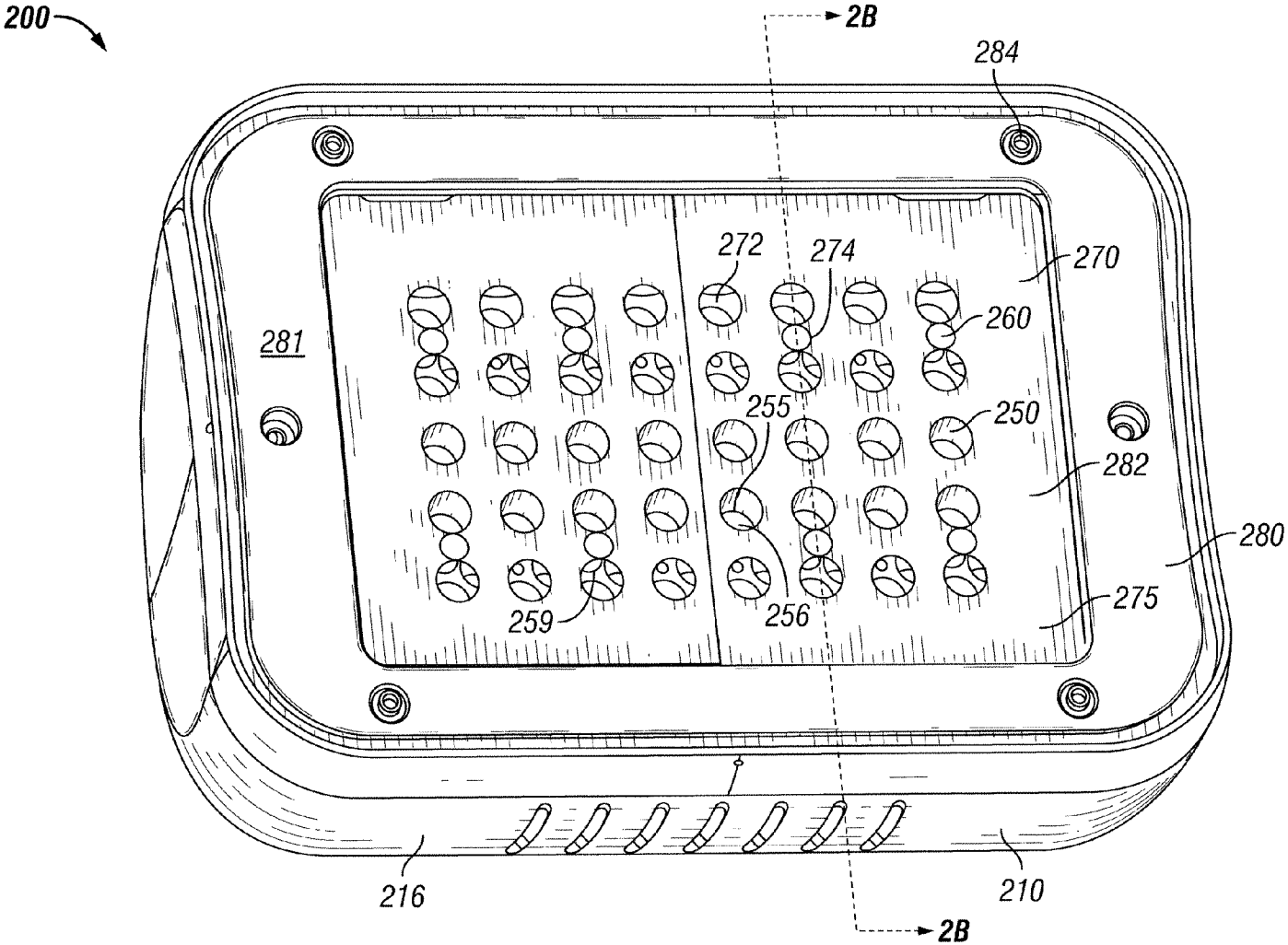
FIG. 2A is a perspective view of an LED light fixture in accordance with an exemplary embodiment.
Figure 2B:
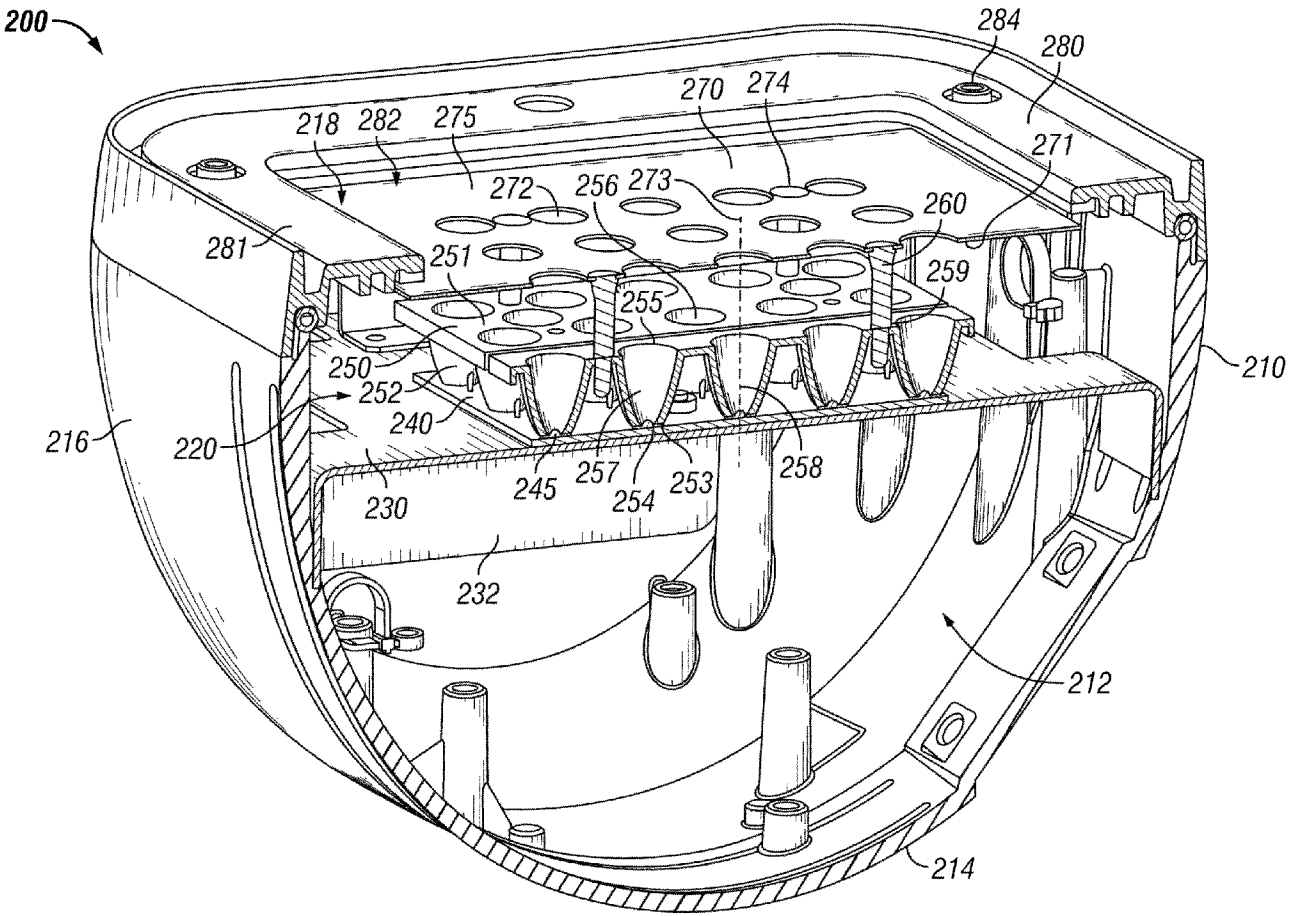
FIG. 2B is a cross-sectional view of the LED light fixture of FIG. 2A in accordance with an exemplary embodiment.

FIG. 2A is a perspective view of an LED light fixture 200 in accordance with an exemplary embodiment. FIG. 2B is a cross-sectional view of the LED light fixture 200 taken along line 2B-2B in accordance with the exemplary embodiment of FIG. 2A. Referring now to FIGS. 2A and 2B, the LED light fixture 200 includes a housing 210, a spill light reducer assembly 220, and a door frame 280. According to some exemplary embodiments, an optional lens (not shown) is coupled to the door frame 280 and disposed over the spill light reducer assembly 220.

In certain exemplary embodiments, the housing 210 includes a back wall 214, multiple side walls 216, a cavity 212 formed therein, and a light-emitting window 218, or opening, through which light is emitted. Each side wall 216 extends outwardly from the perimeter of the back wall 214 such that a portion of one side wall 216 faces at least a portion of another side wall 216. According to certain exemplary embodiments, the back wall 214 has a substantially concave shape. According to some exemplary embodiments, the back wall 214 and the side walls 216 are fabricated from a single component; however, in other exemplary embodiments, one or more side walls 216 are fabricated separately from the back wall 214. The back wall 214 and the multiple side walls 216 collectively define the cavity 212 therein. The cavity 212 is sized and shaped to receive the spill light reducer assembly 220 therein. In certain exemplary embodiments, the spill light reducer assembly 220 is slidably inserted into the cavity 212. In addition, in certain exemplary embodiments, the cavity 212 also houses at least one of a driver (not shown) and a surge module (not shown) that are associated with powering one or more LEDs 245. The housing 210 acts as a heat sink according to some exemplary embodiments. For example, at least a portion of the heat generated from the LEDs 245 is directed towards the housing 210, which then dissipates the heat to the surrounding environment. The heat travels from the LEDs 245, to an LED circuit board 240, to a mounting platform 230, and then to the housing side walls 216. In certain exemplary embodiments, a heat sinking material (not shown), such as a graphite-based material, a silicone-based material, or other suitable heat sinking material, is disposed between the LED circuit board 240 and the mounting platform 230 to increase the rate at which the heat dissipates from the LEDs 245 to the housing 210. This heat dissipation allows the LEDs 245 to operate at a lower temperature than if the heat was not to be dissipated. According to alternative exemplary embodiments, the housing 210 includes a separate heat sink (not shown) coupled thereto, which allows the housing 210 to direct at least a portion of the heat generated from the LEDs 245 to this separate heat sink. This separate heat sink then dissipates the heat to the surrounding environment. The exemplary housing 210 is fabricated using die-cast aluminum. However, other suitable materials, such as plastic, steel, or a combination of suitable materials, are used to manufacture the housing 210 in other exemplary embodiments.

Figure 3:
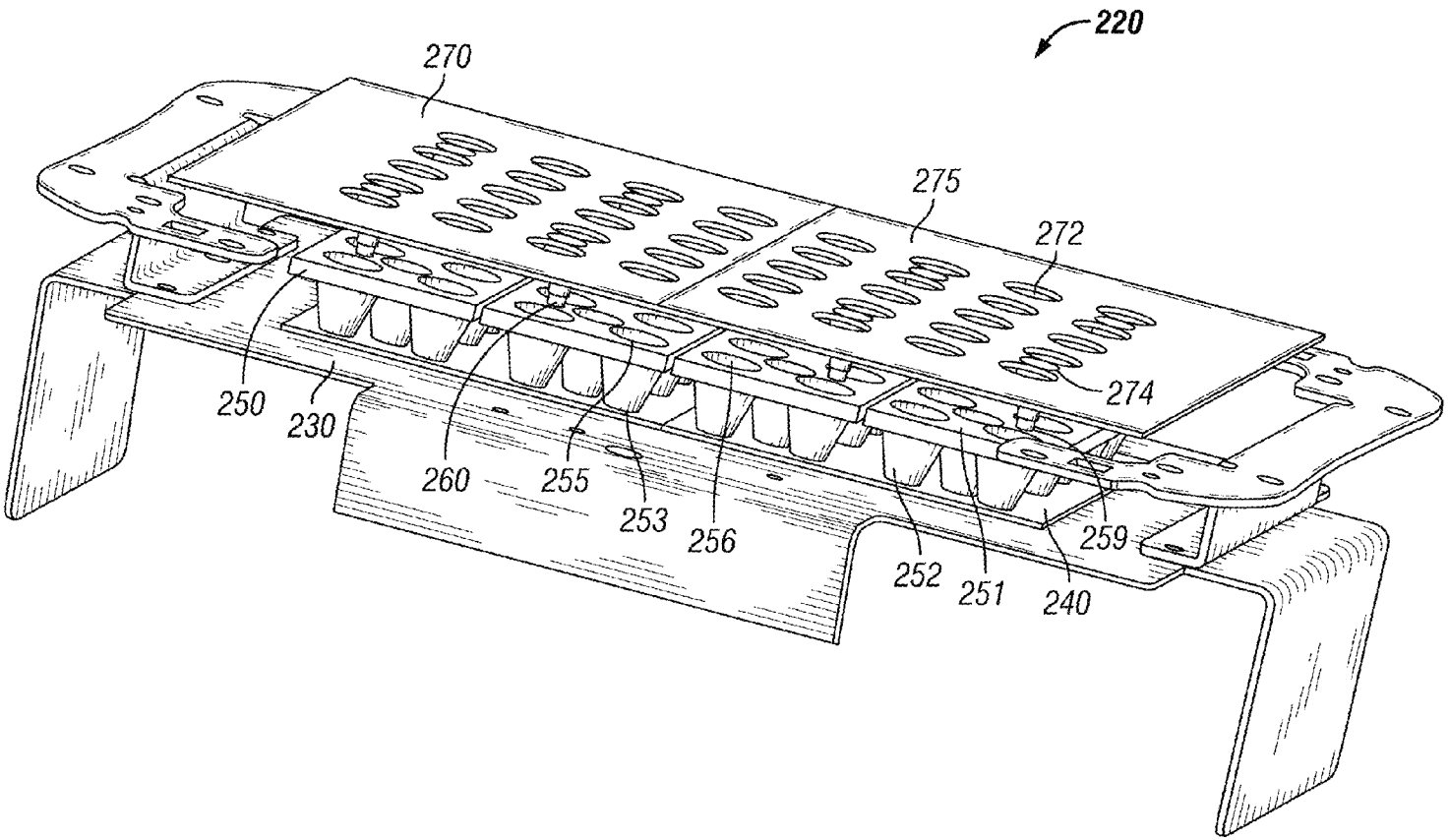
FIG. 3 is a perspective view of a spill light reducer assembly in accordance with an exemplary embodiment.

FIG. 3 is a perspective view of the spill light reducer assembly 220 in accordance with an exemplary embodiment. Referring to FIGS. 2B and 3, the exemplary spill light reducer assembly 220 includes the LED circuit board 240, one or more LEDs 245 coupled to the LED circuit board 240, a reflector assembly module 250 coupled to or disposed above the LED circuit board 240, and a spill light reducer plate 270 positioned at a desired distance 450 (FIG. 4) away from the reflector assembly module 250. In one exemplary embodiment, the spill light reducer assembly 220 also includes one or more spacers 260 disposed substantially between the spill light reducer plate 270 and the reflector assembly module 250 or circuit board 240. The spacers 260 positions the spill light reducer plate 270 at the desired distance 450 (FIG. 4) away from the reflector assembly module 250. In some exemplary embodiments, the spill light reducer assembly 220 also includes a mounting platform 230, which facilitates heat removal from the LED circuit board 240 to the housing 210.

The LED circuit board 240 is disposed within the cavity 212. In certain exemplary embodiments, the LED circuit board 240 is coupled to, or supported within, the housing 210 using known attachment and/or supporting methods and is in thermal communication with the housing 210, or heat sink. For example, the LED circuit board 240 is coupled to the mounting platform 230, which is coupled to the housing 210 using one or more flanges 232 that extend outward (in certain instances orthogonally) from one or more edges of the mounting platform 230. The mounting platform 230 is fabricated using metal, or some other known heat conducting material. The LED circuit board 240 is fabricated using one or more sheets of ceramic, metal, laminate, Mylar®, or other material. One or more LEDs 245, or LED die packages (referred to collectively hereinafter as "LEDs"), are disposed on and/or electrically coupled to the LED circuit board 240 and are configured to emit light. According to one exemplary embodiment, the LEDs 245 are positioned in a rectangularly shaped array and positioned about one-inch apart; however the shape of the array and the distance that each LED 245 is positioned apart from one another is variable and adjustable to suit the needs of the specific lighting application. According to some exemplary embodiments, each LED circuit board 240 includes twenty LEDs 245 arranged in a four by five array. However, the number and configuration of the LEDs 245 are different in other exemplary embodiments. According to some exemplary embodiments, as shown in FIG. 3, there are two LED circuit boards 240 positioned adjacently to one another and coupled to the mounting platform 230. Each LED 245 includes a chip of semi-conductive material that is treated to create a positive-negative ("p-n") junction. When the LED 245 is electrically coupled to a power source, such as a driver (not shown), current flows from the positive side to the negative side of each junction, causing charge carriers to release energy in the form of incoherent light.

The wavelength or color of the emitted light depends on the materials used to make the LED 245. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs 245 in the LED package can produce the same or a distinct color of light. For example, the LED package can include one or more white LED's and one or more non-white LEDs, such as red, yellow, amber, or blue LEDs, for adjusting the color temperature output of the light emitted from the fixture 200. In certain exemplary embodiments, a yellow or multi-chromatic phosphor coats, or otherwise is used in, a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs 245 in the LED package has a color temperature between 2500 and 6000 degrees Kelvin.

In certain exemplary embodiments, an optically transmissive or clear material (not shown) encapsulates at least a portion of each LED 245. This encapsulating material provides environmental protection while transmitting light from the LEDs 245. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In some exemplary embodiments, each of the LEDs 245 emits white or substantially white light. However, one or more LEDs 245 emit non-white light in other exemplary embodiments.

The reflector assembly module 250 includes a first surface 251 and one or more reflectors 252 extending downward from the first surface 251. In certain exemplary embodiments, the reflectors 252 have a substantially elliptical shape and are arranged in an array within the reflector assembly module 250 in a manner corresponding to the array of LEDs 245. In alternative exemplary embodiments, the reflector 252 arrangement is modified in one or more different ways that are within the scope and spirit of this disclosure. In some exemplary embodiments, each reflector 252 is disposed over a corresponding LED 245. Alternatively, each reflector 252 in the reflector assembly module 250 is disposed around multiple LEDs 245. The exemplary reflector assembly module 250 has a rectangular shape. In alternative embodiments, the reflector assembly module 250 is shaped in other geometric or non-geometric shapes.

The exemplary reflector assembly module 250 includes ten reflectors 252 arranged in a two by five rectangular array. Thus, in the exemplary embodiment where each LED circuit board 240 includes twenty LEDs 245, two reflector assembly modules 250 are disposed on, or above, the LED circuit board 240. In alternative embodiments, a greater or fewer number of reflectors 252 are arranged in any array shape including, but not limited to, circular, square, triangular, or any other geometric or non-geometric shape. Thus, in alternative embodiments where the LED circuit board 240 includes twenty LEDs 245, as few as one reflector assembly module 250 that includes twenty reflectors 252 is capable of being disposed on, or above, the LED circuit board 240. In some exemplary embodiments, each reflector 252 is integrally formed into the reflector assembly module 250 as a single component. Alternatively, at least one reflector 252 is separately formed from the reflector assembly module 250 and thereafter coupled to the reflector assembly module 250 using a screw, rivet, weld or any other fastening means (not shown) known to persons having ordinary skill in the art.

Each reflector 252 includes a proximal end 253, a distal end 255, and an internal surface 257 extending from the proximal end 253 to the distal end 255. The proximal end 253 is positioned distally from the first surface 251, while the distal end 255 is positioned at or adjacent to the first surface 251. The proximal end 253 forms a proximal opening 254 and the distal end 255 forms a distal opening 256. In some exemplary embodiments, each of the proximal openings 254 and the distal openings 256 are circular or substantially circular in shape. Each proximal opening 254 is typically positioned adjacent to the LED circuit board 240 and surrounds one or more LEDs 245. Each reflector 252 also includes an axial axis 258 that includes the centerpoint of the proximal opening 254 and the centerpoint of the distal opening 256. In one exemplary embodiment, the diameter of the proximal opening 254 is less than the diameter of the distal opening 256. For example, the diameter of the distal opening 256 is about 0.6 inches and the diameter of the proximal opening is about 0.13 inches. However, in alternative exemplary embodiments, the diameter of the proximal opening 254 is equal to or greater than the diameter of the distal opening 256. According to some exemplary embodiments, the internal surface 257 is smooth. Alternatively, the internal surface 257 is faceted, dimpled, or uneven. The exemplary reflector 252 has a parabolic or elliptical shape; however, other shapes, including but not limited to, conical or any other geometric and non-geometric shapes for the reflector 252, are within the scope and spirit of the exemplary embodiment.

At least a portion of the reflector assembly module 250 and the reflectors 252 is fabricated from plastic material including, but not limited to, polymethylmethacrylate ("PMMA") or polycarbonate according to certain exemplary embodiments. At least a portion of the exemplary plastic material, including the internal surface 257, is coated with a metallic material, such as aluminum or stainless steel using a vacuum metalizing process. Other materials may be used in lieu of, or in addition to, the plastic base material and metalized coating. These materials include, but are not limited to, spun aluminum, turned aluminum, or any other reflective material known to people having ordinary skill in the art.

The reflector assembly module 250 includes one or more attachment openings 259 on the first surface 251. These attachment openings 259 are formed during the fabrication of the reflector assembly module 250 according to certain exemplary embodiments. Alternatively, these attachment openings 259 are formed subsequent to the fabrication of the reflector assembly module 250 by, for example, punching holes through the first surface 251 to form these attachment openings 259. Spacers 260 are positioned through the attachment openings 259 to facilitate coupling of the reflector assembly module 250 to the spill light reducer plate 270 and to properly distance the spill light reducer plate 270 from the reflector assembly module 250. The exemplary spacers 260 are the snap-in or push-in types, such as printed circuit board ("PCB") spacers, pegs, and other known fastener types. Alternatively, spacers of a different type, such as screw-in types or a combination of screw-in and snap-in types, are used. In lieu of, or in addition to, the attachment opening 259, other attachment means known to people having ordinary skill in the art are capable of attaching the reflector assembly module 250 above the spill light reducer plate 270 and properly distancing the spill light reducer plate 270 from the reflector assembly module 250. For example, in an alternative embodiment, the spill light reducer plate 270 is coupled to the door frame 280 which positions the reflector assembly module 250 above the spill light reducer plate 270 and properly distances the spill light reducer plate 270 from the reflector assembly module 250. In alternative exemplary embodiments, the reflector assembly module 250 includes one or more refractors (not shown) in lieu of, or in addition to, the one or more reflectors formed therein.

The spill light reducer plate 270 includes a first surface 271 and a second surface 275 that is substantially parallel to the first surface and facing a direction that is opposite to the direction that the first surface 271 faces. The spill light reducer plate 270 also includes one or more openings 272 and one or more attachment apertures 274 formed therein. The openings 272 extend from the first surface 271 to the second surface 275 and provide a passageway through the plate 270. The openings 272 are positioned in an array that is the same as or substantially similar to the array of distal openings 256. In one exemplary embodiment, the spill light reducer plate 270 includes twenty openings 272 arranged in a five by four array; however, the number of openings 272 and the configuration of the array are different in other exemplary embodiments. Each opening 272 includes a corresponding opening axial axis 273. Each opening 272 is positioned above a corresponding distal opening 256 in a manner such that the first surface 271 faces the reflector assembly module 250 and the opening axial axis 273 is aligned with the reflector axial axis 258. In certain exemplary embodiments, each opening 272 has a diameter that is equal to the diameter of the corresponding distal opening 256. Alternatively, each opening 272 has a diameter that is smaller than the diameter of its corresponding distal opening 256. In another exemplary embodiment, each opening 272 has a diameter that is larger than the diameter of its corresponding distal opening 256 pursuant to the relationship described below with respect to FIG. 4. In one example, the diameter of the openings 272 are about 0.6 inches when the diameter of the distal opening also is about 0.6 inches.

In the illustration provided in FIG. 3, two spill light reducer plates 270 are positioned adjacent to one another. Each spill light reducer plate 270 is positioned above a respective LED circuit board 240. This positioning of the LED circuit boards 240 and the spill light reducer plates 270 allows for tolerances in the spacing between adjacent LED circuit boards 240 and adjacent spill light reducer plates 270. In an alternative embodiment, such as the one shown in FIGS. 5A and 5B and which is described in further detail below, each adjacently positioned spill light reducer plate 270 overlaps the other once positioned above the LED circuit boards 240.

Each attachment aperture 274 is positioned generally above a corresponding attachment opening 259. Each spacer 260 inserted through the attachment opening 259 also is inserted through a corresponding attachment aperture 274. The spacer 260 helps to maintain the spill light reducer plate 270 the desired distance 450 (FIG. 4) away from the top surface 251 of the reflector assembly module 250. In one exemplary embodiment, the desired distance 450 (FIG. 4) is about 0.75 inches when the openings 272 and the distal openings 256 are about 0.6 inches in diameter. In certain exemplary embodiments, the desired distance 450 (FIG. 4) is between about 0.6-0.8 inches when the openings 272 and the distal openings 256 are about 0.6 inches in diameter.

The exemplary spill light reducer plate 270 is fabricated using sheet metal, but other suitable materials, such as plastic, are capable substitutes. The first surface 271 is fabricated to have minimal light reflective properties in certain exemplary embodiments. For example, the first surface 271 is painted black, or some other dark color to absorb any light not directly exiting the opening 272. Alternatively, a minimally reflective material, such as a dark colored plastic (not shown), is coupled to the first surface 271 using, for example, an adhesive to absorb the light that is not directly exiting the opening 272. In another alternative, the spill light reducer plate 270 is fabricated using a minimally reflective material, such as a dark colored plastic.

The door frame 280 includes multiple side walls 281 and a light-emitting window 282, or opening, through which light from the LEDs 245 is emitted. The multiple side walls 281 are coupled to the multiple side walls 216 of the housing 210 with, for example, a screw 284, or bolt. Alternatively, the door frame 280 is coupled to the housing 210 using snap-fitting, hinges, or other methods known to people having ordinary skill in the art. In some exemplary embodiments, a lens (not shown) is coupled to one or more of the multiple side walls 281 and is disposed within the light-emitting window 282. The exemplary lens provides protection to the internal components from at least dust, bugs, and/or weather.

Figure 4:
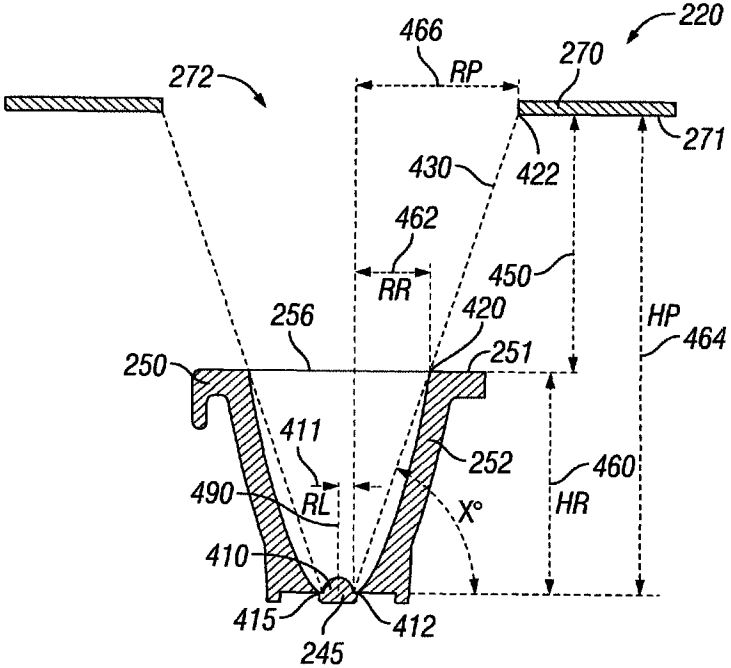
FIG. 4 is a side elevation view of a portion of the spill light reducer assembly of FIG. 3 in accordance with an exemplary embodiment.

FIG. 4 is a side elevation view of a portion of the spill light reducer assembly 220 in accordance with an exemplary embodiment. FIG. 4 also illustrates one example of the relationship between the size of the distal opening 256, the maximum size of the opening 272, and the desired distance 450 between the first surface 251 of the reflector assembly module 250 and the first surface 271 of the spill light reducer plate 270. Referring to FIG. 4, the exemplary reflector 252 is disposed around the LED 245 and the light spill reducer plate 270 is positioned the desired distance 450 above the reflector 252.

The exemplary LED 245 includes an LED encapsulant 410 positioned on an LED base 415. The exemplary LED encapsulant 410 is dome-shaped and the exemplary LED base 415 is rectangularly-shaped. However, both the LED encapsulant 410 and the LED base 415 are capable of having different shapes, such as an alternative LED base 415 being circular. In some exemplary embodiments, the LED encapsulant 410 has an LED encapsulant radius ("RL") 411 that is measured substantially near where the LED encapsulant 410 contacts the LED base 415. The LED encapsulant radius 411 is measured as the distance from an LED encapsulant's central axis 490 to the edge of the LED encapsulant 410 where the LED encapsulant 410 meets with the LED base 415. An LED encapsulant circumference point 412 is positioned along the circumference of the LED encapsulant 410, which is formed by the LED encapsulant radius 411. Similarly, a distal opening circumference point 420 is positioned along the circumference of the distal opening 256. In addition, an opening circumference point 422 is positioned along the circumference of the opening 272 on the spill light reducer plate's first surface 271. Each of the LED encapsulant circumference point 412, the distal opening circumference point 420, and the opening circumference point 422 are positioned such that a light beam 430 having the shortest possible distance extends from the LED encapsulant circumference point 412, through the distal opening circumference point 420, and to the opening circumference point 422.

In one exemplary embodiment, the relationship between the radius of the distal opening 256, the maximum radius of the opening 272, and the desired distance 450 between the first surface 251 of the reflector assembly module 250 and the first surface 271 of the spill light reducer plate 270 is determined by the following equation:

$$HR/RR=HP/RP \quad (1)$$

where,

HR=vertical distance component 460 of a portion of the light beam 430 extending from the LED encapsulant circumference point 412 to the distal opening circumference point 420;

RR=horizontal distance component 462 of a portion of the light beam 430 extending from the LED encapsulant circumference point 412 to the distal opening circumference point 420;

HP=vertical distance component 464 of a portion of the light beam 430 extending from the LED encapsulant circumference point 412 to the opening circumference point 422; and RP=horizontal distance component 466 of a portion of the light beam 430 extending from the LED encapsulant circumference point 412 to the opening circumference point 422.

The LED encapsulant radius 411 is added to the horizontal distance component 462 and horizontal distance component 466 to obtain the radius of the distal opening 256 and the maximum radius of the opening 272, respectively. Although this relationship provides an exemplary method for determining the maximum radius of the opening 272 that reduces the amount of spill light being emitted from the fixture 200 (FIG. 2A), a smaller radius for the opening 272 is used in alternative embodiments to further reduce the amount of spill light being emitted from the fixture 200 (FIG. 2A). However, as the radius of the opening 272 is reduced to a value smaller than the maximum radius of the opening 272, the portion of the primary light beam being emitted from the fixture 200 also is reduced. In some exemplary embodiments, the desired distance 450 between the first surface 251 of the reflector assembly module 250 and the first surface 271 of the spill light reducer plate 270 is determined by subtracting the vertical distance component 460 from the vertical distance component 464.

Figure 5A:
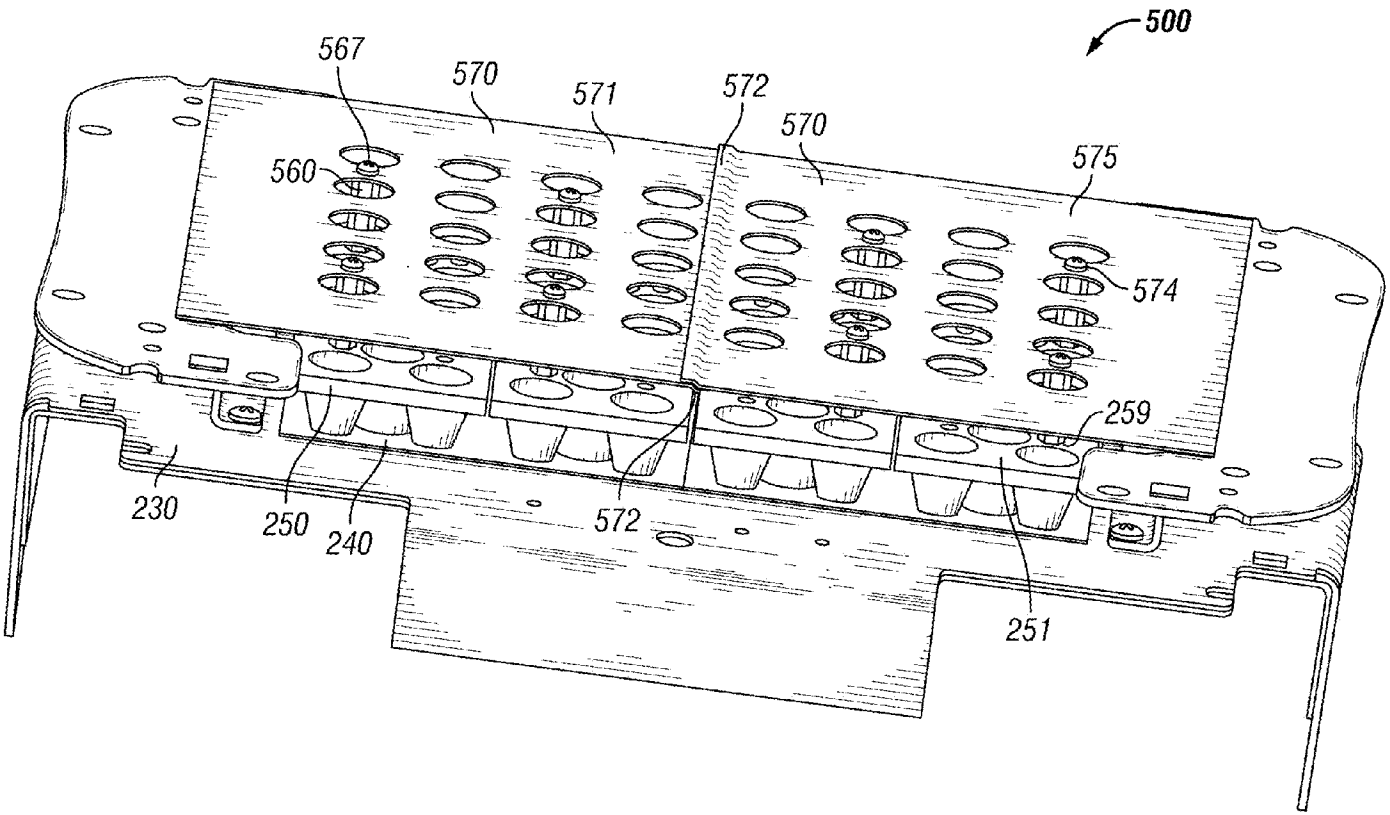
FIG. 5A is a perspective view of a spill light reducer assembly in accordance with another exemplary embodiment.
Figure 5B:
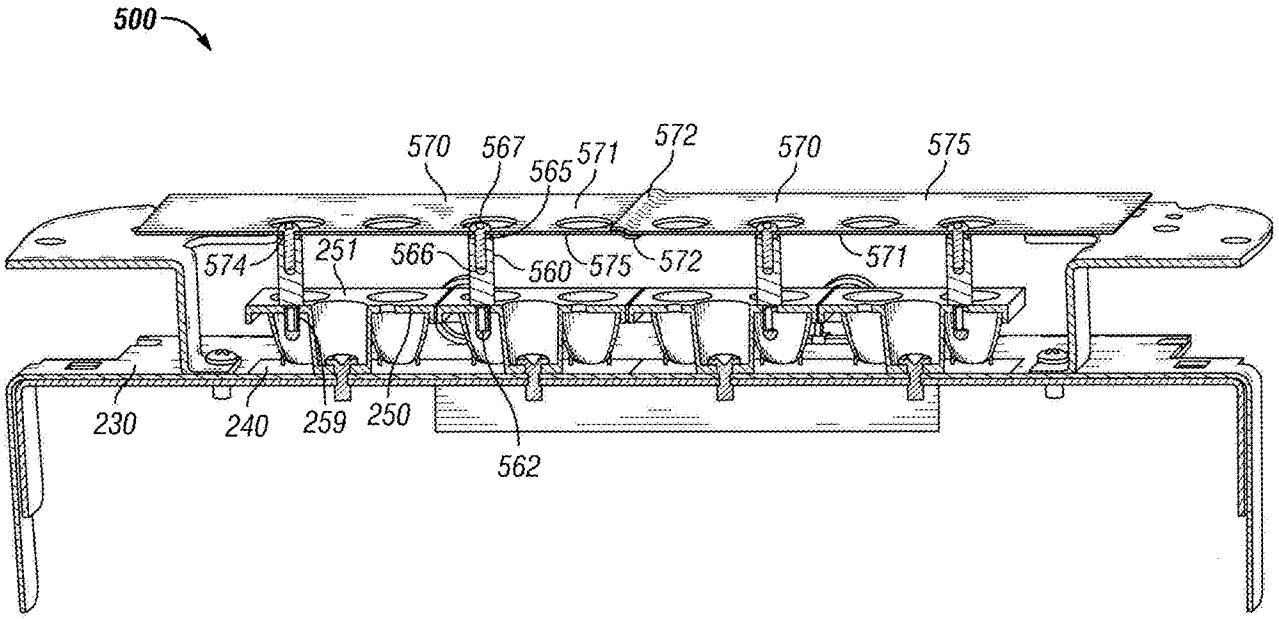
FIG. 5B is a cross-sectional view of the spill light reducer assembly of FIG. 5A in accordance with another exemplary embodiment.

FIG. 5A is a perspective view of an spill light reducer assembly 500 in accordance with another exemplary embodiment. FIG. 5B is a cross-sectional view of the spill light reducer assembly 500 of FIG. 5A. Now referring to FIGS. 5A and 5B, the exemplary spill light reducer assembly 500 is similar to the exemplary spill light reducer assembly 220 (FIG. 2B) and includes the mounting platform 230, the LED circuit board 240, one or more LEDs (not shown) coupled to the LED circuit board 240, and the reflector assembly module 250 coupled to or disposed above the LED circuit board 240. Each of these components has been previously described above and is not repeated herein for the sake of brevity.

The exemplary spill light reducer assembly 500 also includes a spill light reducer plate 570, which is similar to the spill light reducer plate 270 (FIG. 2B), except that the spill light reducer plate 570 includes a raised flange 572 at one end of the spill light reducer plate 570. The spill light reducer plate 570 is positioned at a desired distance 450 (FIG. 4) away from the reflector assembly module 250, which is determined, for example, according to the previously described exemplary method. The spill light reducer assembly 500 also includes spacers 560 that function similarly to the spacers 260 (FIG. 2A).

The spill light reducer plate 570 includes the raised flange 572 along one end and is elevationally at a different height that at least a portion of the remaining spill light reducer plate 570. The spill light reducer plate 570 also includes a first surface 571, a second surface 575, one or more openings 572 extending from the first surface 571 to the second surface 575, and one or more attachment apertures 574 extending from the first surface 571 to the second surface 575. Each of the first surface 571, the second surface 575, openings 572, and attachment apertures 574 is similar to corresponding element previously described with respect to the spill light reducer plate 270 (FIG. 2B). According to the illustration shown in FIGS. 5A and 5B, there are two spill light reducer plates 570 positioned adjacent one another. One spill light reducer plate 570 is positioned with the first surface 571 facing the reflector assembly module 250, thereby having the raised flange 572 positioned elevationally above the second surface 575. The second spill light reducer plate 570 is positioned with the second surface 575 facing the reflector assembly module 250, thereby having the raised flange 572 positioned elevationally below the second surface 575. Thus, each of the raised flanges 572 overlap one another and prevent light leak between the two adjacently positioned spill light reducer plates 570. Although one method and/or device has been described and illustrated for preventing and/or reducing light spills from between two adjacently positioned spill light reducer plates 570, other devices and methods known to people having ordinary skill in the art and having the benefit of the present disclosure can be used in other exemplary embodiments.

As previously mentioned, the reflector assembly module 250 includes one or more attachment openings 259 formed in the first surface 251 of the reflector assembly module 250 and the spill light reducer plate 570 includes one or more attachment apertures 574 extending from the first surface 571 to the second surface 575 of the spill light reducer plate 570. Each of the attachment apertures 574 are axially aligned above a corresponding attachment opening 259 and both are used to facilitate coupling of the reflector assembly module 250 to the spill light reducer plate 570 and to properly distance the spill light reducer plate 570 from the reflector assembly module 250.

Spacer 560 includes a first end 562 and a second end 565. Each first end 562 is inserted into a corresponding attachment opening 259 formed within the reflector assembly module 250. According to certain exemplary embodiments, the insertion of the first end 562 into the attachment opening 259 is a snap-fit insertion; however, this insertion type is different in other exemplary embodiments. Each second end 565 includes a cavity 566 formed therein which extends towards the first end 562. In one exemplary embodiment, the cavity 566 is threaded. Each second end 565 is positioned adjacent to and below a corresponding attachment aperture 274. Alternatively, each second end 565 is positioned within or adjacent to and above the corresponding attachment aperture 274, where at least a portion of the spacer 560 is inserted within the attachment aperture 274. A fastener 567, such as a screw, nail, or rivet, is inserted into the cavity 566 through the attachment aperture 274 to securely position the spacer 560 between the reflector assembly module 250 and the spill light reducer plate 270. Thus, the second end 565 is screw-fitted to the spill light reducer plate 570.

Figure 6:
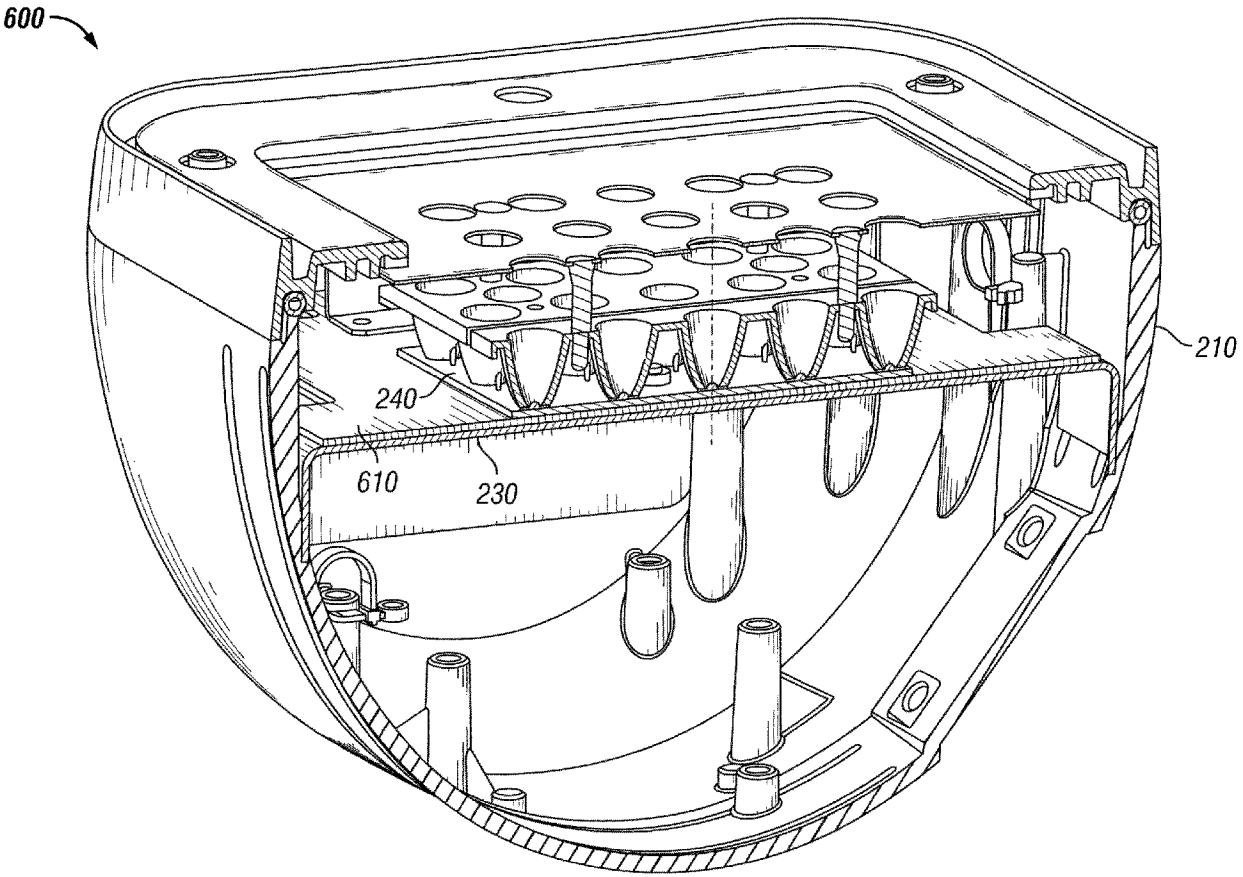
FIG. 6 is a cross-sectional view of an LED light fixture in accordance with another exemplary embodiment.

FIG. 6 is a cross-sectional view of an LED light fixture 600 in accordance with another exemplary embodiment. Referring to FIG. 6, the LED light fixture 600 is similar to the LED light fixture 200 (FIG. 2B), except that the LED light fixture 600 includes a heat sinking material 610 disposed between the LED circuit board 240 and the mounting platform 230, which have both been previously described. According to some exemplary embodiments, the heat sinking material 610 is fabricated using a thermally-conductive component, such as a graphite-based component, a silicone-based component, or any other suitable thermally conductive components. The heat sinking material 610 is disposed between the LED circuit board 240 and the mounting plate 230 in a padded form in some exemplary embodiments. However, in other exemplary embodiments, the heat sinking material 610 is disposed between the LED circuit board 240 and the mounting plate 230 in a liquid form which is then solidified. According to this exemplary embodiment, the heat sinking material 610 enhances heat transfer between the LED circuit board 240 to the mounting platform 230, which then transfers heat to the housing 210, which then dissipates heat to the exterior surrounding environment.

Although each exemplary embodiment has been described in detail, it is to be construed that any features and modifications that are applicable to one embodiment are also applicable to the other embodiments. Furthermore, although the inventive aspects has been described with reference to specific embodiments, these descriptions are not meant to be construed in a limiting sense. Various modifications of the disclosed embodiments, as well as alternative embodiments will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A spill light reducer assembly, comprising:

at least one light source;

at least one reflector, each reflector comprising:

a reflector proximal end disposed around the light source;

a reflector distal end forming a distal opening; and a reflector internal surface extending from the reflector proximal end to the reflector distal end; and a spill light reducer plate comprising a bottom surface positioned facing the reflector and having at least one opening formed therein, the opening being positioned a predetermined distance above the distal opening and the bottom surface being positioned distally away from the reflector distal end forming a gap therebetween, wherein a diameter of the opening of the spill light reducer plate is larger than a diameter of the distal opening and smaller than a maximum radius, the maximum radius being defined by [(HP)(RR)/HR]+RL, wherein HP is a vertical distance component between the reflector proximal end and the spill light reducer plate, wherein RR is a horizontal distance component between a circumferential point of the light source and a circumferential point of the distal opening, the circumferential point of the distal opening being nearest to the circumferential point of the light source, wherein HR is a vertical distance component between the reflector proximal end and the reflector distal end, and wherein RL is a radius of the light source.

2. The spill light reducer assembly of claim 1, wherein the spill light reducer plate comprises a first surface facing the reflector, the first surface made to be light absorbent.

3. The spill light reducer assembly of claim 1, wherein the distal opening is aligned with the opening of the spill light reducer plate.

4. The spill light reducer assembly of claim 1, further comprising:

a reflector assembly module comprising one or more of the reflectors; and one or more spacers coupled to the reflector assembly module at one end and extending towards the spill light reducer plate, each spacer positioning the spill light reducer plate the predetermined distance away from the distal opening.

5. The spill light reducer assembly of claim 4, wherein the spacer comprises a first end and a second end positioned opposite the first end, the second end defining an opening extending towards the first end, the opening being sized to receive a fastener.

6. The spill light reducer assembly of claim 1, wherein the light source comprises at least one light emitting diode.

7. A light fixture, comprising:

a housing comprising:

one or more sidewalls, the sidewalls forming a light emitting window; and a cavity disposed within the housing and defined by the sidewalls;

a plurality of light emitting diodes (LEDs) disposed within the cavity;

at least one reflector disposed at least partially within the cavity, each reflector comprising:

a reflector proximal end surrounding at least one LED;

a reflector distal end forming a distal opening; and a reflector internal surface extending from the reflector proximal end to the reflector distal end; and a spill light reducer plate disposed within the cavity and comprising a bottom surface positioned facing the reflector and at least one opening formed therethrough, at least a portion of the opening being aligned with a portion of the distal opening and positioned a predetermined distance away from the distal opening, the bottom surface being positioned distally away from the reflector distal end forming a gap therebetween, wherein a diameter of the opening of the spill light reducer plate is larger than a diameter of the distal opening and smaller than a maximum radius, the maximum radius being defined by [(HP)(RR)/HR]+RL, wherein HP is a vertical distance component between the reflector proximal end and the spill light reducer plate, wherein RR is a horizontal distance component between a circumferential point of the light source and a circumferential point of the distal opening, the circumferential point of the distal opening being nearest to the circumferential point of the light source, wherein HR is a vertical distance component between the reflector proximal end and the reflector distal end, and wherein RL is a radius of the light source.

8. The light fixture of claim 7, wherein the spill light reducer plate comprises a light absorbing first surface facing the reflector.

9. The light fixture of claim 7, wherein each distal opening is vertically aligned with a corresponding one of the openings of the spill light reducer plate.

10. The light fixture of claim 7, further comprising:

a reflector assembly module comprising one or more of the reflectors; and one or more spacers coupled to the reflector assembly module at one end and extending towards the spill light reducer plate, each spacer positioning the spill light reducer plate the predetermined distance away from the distal opening.

11. The light fixture of claim 7, further comprising a door frame coupled to the sidewalls of the housing, the door frame comprising a second light emitting window allowing light from the LEDs to pass therethrough, the door frame positioning the spill light reducer plate the predetermined distance away from the distal opening.

12. The light fixture of claim 7, further comprising:

a substrate, the substrate being coupled to the LEDs;

a mounting plate coupled to the substrate and the housing, the mounting plate facilitating heat removal from the substrate to the housing, the mounting plate positioning the substrate within the cavity.

13. A method for reducing spill light from a light source, the method comprising:

placing a reflector over one or more light sources, the reflector comprising:

a reflector proximal end;

a reflector distal end forming a distal opening; and a reflector internal surface extending from the reflector proximal end to the reflector distal end;

positioning a spill light reducer plate a predetermined distance away from the reflector, the spill light reducer plate comprising a bottom surface positioned facing the reflector and having at least one opening formed therein, the bottom surface being positioned distally away from the reflector distal end forming a gap therebetween, wherein a diameter of the opening of the spill light reducer plate is larger than a diameter of the distal opening and smaller than a maximum radius, the maximum radius being defined by [(HP)(RR)/HR]+RL, wherein HP is a vertical distance component between the reflector proximal end and the spill light reducer plate, wherein RR is a horizontal distance component between a circumferential point of the light source and a circumferential point of the distal opening, the circumferential point of the distal opening being nearest to the circumferential point of the light source, wherein HR is a vertical distance component between the reflector proximal end and the reflector distal end, and wherein RL is a radius of the light source.

14. The method of claim 13, wherein the spill light reducer plate comprises a light absorbing first surface facing the reflector.

15. The method of claim 13, wherein the distal opening comprises a reflector axial axis, and wherein the opening of the spill light reducer plate comprises an opening axial axis, the reflector axial axis being aligned with the opening axial axis.

16. The method of claim 13, wherein positioning a spill light reducer plate a predetermined distance away from the reflector comprises coupling one or more spacers to the spill light reducer plate and to a reflector assembly module, the reflector assembly module comprising the one or more of the reflectors, each spacer positioning the spill light reducer plate the predetermined distance away from the distal opening.

17. The method of claim 13, wherein the light source comprises at least one light emitting diode.

* * * * *